US006184616B1

(12) United States Patent
Amano et al.

(10) Patent No.: US 6,184,616 B1
(45) Date of Patent: Feb. 6, 2001

(54) RESISTOR ELECTRON GUN FOR CATHODE-RAY TUBE USING THE SAME AND METHOD OF MANUFACTURING RESISTOR

(75) Inventors: Yasunobu Amano, Tokyo; Katsuyuki Yodokawa, Kanagawa; Kazuo Kajiwara, Tokyo; Naruhiko Endo, Fukushima; Kazutaka Nakayama, Aichi, all of (JP)

(73) Assignee: Sony Corporation, Tokyo (JP)

( * ) Notice: Under 35 U.S.C. 154(b), the term of this patent shall be extended for 0 days.

(21) Appl. No.: 09/220,572

(22) Filed: Dec. 23, 1998

(30) Foreign Application Priority Data

Dec. 26, 1997 (JP) ..... 9-359764

(51) Int. Cl.[7] ..... H01J 29/46
(52) U.S. Cl. ..... 313/441
(58) Field of Search ..... 313/441, 449; 315/3; 338/308; 257/411; 427/103

(56) References Cited

U.S. PATENT DOCUMENTS

| | | | | |
|---|---|---|---|---|
| 3,754,989 | | 8/1973 | Bockstie, Jr. . | |
| 4,107,387 | * | 8/1978 | Boonstra et al. | 428/426 |
| 4,292,619 | * | 9/1981 | Mutsaers et al. | 338/308 |
| 4,760,370 | * | 7/1988 | Nikaido et al. | 338/308 |
| 4,859,241 | * | 8/1989 | Grundy | 106/1.14 |
| 5,071,228 | * | 12/1991 | Waldmann et al. | 359/63 |
| 5,917,225 | * | 6/1999 | Yamazaki et al. | 257/411 |

FOREIGN PATENT DOCUMENTS 0 251 137 A2 1/1988 (EP) .

OTHER PUBLICATIONS

Database WPI, Section Ch, Week 7808 Derwent Publications Ltd., Lodnon, GB; AN 78–14653a; XP002104187; & JP 53 001458 A (Tokyo Shibaura Electric Co); Sep. 3, 1984 *Abstract*.

SID (Society for Information Display) 1997 Digest, pp. 347–350. N. Endo et al. (May) An Extended Gun with Extended–Field Ellipticall Aperture Lens.

* cited by examiner

*Primary Examiner*—Vip Patel
*Assistant Examiner*—Todd Reed Hopper
(74) *Attorney, Agent, or Firm*—Ronald P. Kananen; Rader, Fishman & Grauer

(57) ABSTRACT

There are disclosed a resistor whose life span is long and whose miniaturization can be implemented by restraining a short-circuit among a resistor pattern, an electron gun for a cathode-ray tube provided with the resistor and a method of manufacturing the resistor.

In the resistor (2), the natrium concentration of overcoat glass (4) coated on a surface thereof and covering its resistance patterns (5) is set to less than 500 ppm, and the resistor 2 is manufactured in such a manner that at a time when the overcoat glass (4) is manufactured, after a process (S2) of crushing a glass cullet which is a raw material of the overcoat glass (4), the crushed glass powder is raised with pure water to thereby set the natrium concentration thereof to less than 500 ppm.

5 Claims, 5 Drawing Sheets

RESISTOR ELECTRON GUN FOR CATHODE-RAY TUBE USING THE SAME AND METHOD OF MANUFACTURING RESISTOR

BACKGROUND OF THE INVENTION

1. Field of the Invention

The present invention relates to a resistor the surface of which is coated with an overcoat glass to cover its resistor pattern, an electron gun for a cathode-ray tube using the same and a method of manufacturing the resistor.

2. Description of the Related Art

In recent years, demand has increased for a high resolution in a television, a display and the like.

To this end, as shown in FIG. 1, for example, an electron gun 31 having a common electric field extended lens i.e. an Extended Field Elliptical Aperture Lens referred to as "EFEAL" structure was developed and has become commercial. See SID '97 DIGEST p347–350 (1997).

This electron gun 31 is comprised of, though not shown, three cathodes K for generating electron beams corresponding to three colors or a red R, a green G and a blue B; respective electrodes, that is, a first electrode $G_1$, a second electrode $G_2$, a third electrode $G_3$, a fourth electrode $G_4$, a fifth electrode $G_5$, an intermediate electrode GM which will be explained later, a sixth electrode $G_6$ and a convergence cup 35 for accelerating and controlling the electron beams. The gun 31 is attached with a resistor 32 substantially parallel to a longitudinal direction of the electron gun 31. In FIG. 1, reference numeral 33 designates a stem and reference numeral 34 denotes a stem pin.

This electron gun 31 with the EFEAL structure needs a new electrode for applying an intermediate voltage (for example, 14 kV) between a conventional focus voltage (for example, 6 kV) and an anode voltage (for example, 27 kV).

To this end, the intermediate electrode GM is provided between the sixth electrode G6 on an anode side and the fifth electrode $G_5$, or the focus electrode. The electron gun 31 having the EFEAL structure is such that the fifth electric electrode $G_5$, the intermediate electrode GM and the sixth electrode $G_6$ have, though not shown, electric field correcting electrode boards therein, each of which has beam penetration apertures corresponding to the three electron beams, and each of the electrodes $G_5$, GM, and $G_6$ is shaped like a cylinder which is cross-sectionally elliptical.

Then, by applying the above-mentioned intermediate voltage of, for example, 14 kV to the intermediate electrode GM, the penetration of the electric field to the beam penetration apertures of the electric field correcting electrode board (not shown) of the intermediate electrode GM controls the shape of the electron beams and the convergence thereof, thereby making it possible to optimize them.

Here, a voltage which can be applied through the stem pin 34 to the electron gun from the outside of the cathode-ray tube is limited to about 10 kV or so due to a withstand voltage characteristic between the pins.

Therefore, in order to apply the intermediate voltage of, for example, 14 kV and the like to the intermediate electrode GM, the resistor 32 becomes indispensable for connecting the low voltage from the stem pin 34 with the high voltage on the anode side and then driving the same.

FIGS. 2A and 2B show the resistor 32 of the electron gun 31 in FIG. 1. The cross-sectional view of resistor 32 is shown in FIG. 2A and the plan view thereof is shown in FIG. 2B. The resistor 32 is formed in such a manner that a conductive film is coated on one surface of a ceramic substrate 36 made of, for example, alumina and the like with a predetermined pattern, printed and fired to form a resistor pattern 37.

Then, an overcoat glass 38 is formed on the resistor pattern 37 and on the rear surface of the ceramic substrate 36 in order to protect the resistor pattern 37. Thus, the resistor 32 is formed.

The resistor 32 thus formed is fitted to the electron gun 31 with its surface of the ceramic substrate 36, on which the resistor pattern 37 is formed, being on the side of the electron gun 31 and its surface on the opposite side being outside, that is, on the neck-glass side of the cathode-ray tube.

An anode voltage, for example, a high voltage of 25–32 kV or so is applied to a high voltage electrode portion 39 at the left end of the resistor 32 and an earth electrode portion 41 at the right end thereof is grounded or is connected to an outer-fitted resistor outside the cathode-ray tube.

In the electron gun 31 of FIG. 1, the high voltage electrode portion 39 is connected to the convergence cup 35, the earth electrode portion 41 is grounded through the stem pin 34 and an intermediate electrode portion 40 of the resistor 32 is connected to the intermediate electrode GM.

The above-mentioned resistor 32 comprises, for example, a so-called inner dividing resistor (IBR: Inner Breeder Resistor), an IMR (Inner Middle voltage breeder Resistor), an IFR (Inner Focus breeder Resistor) and the like, and is used for applying a convergence voltage to obtain a convergence characteristic of the electron gun for the cathode-ray tube, applying a focus voltage of the electron gun for the cathode-ray and further, is used as a focus controller of a television receiver and the like other than for applying the intermediate voltage to the above-mentioned intermediate electrode GM.

However, in the case of such a resistor 32, there generates a growth of dendrite due to ion migration of natrium while it is in operation, resulting in a phenomenon that a portion between the resistor pattern 37 is electrically conducted.

For example, as shown in FIG. 2B, on the interface between the overcoat glass 38 and the ceramic substrate 36, there generates a growth of a dendrite 42 from an edge portion of the overcoat glass 38 toward the resistor pattern 37.

The growth of the dendrite 42 can be explained as follows.

As shown in FIG. 3, a natrium atom is ionized from $Na_2O$ which is contained in the overcoat glass, the ceramic substrate and the resistor pattern as an impurity, and hence there is generated a natrium ion $Na^+$. This natrium ion $Na^+$ causes the ion migration along an electric potential gradient and moves to a cathode side (a low electric potential side) K.

Further, on the cathode side K, it absorbs oxygen from oxides in surrounding portion and precipitates as a layer of sodium oxide $Na_2O$ with the result that the dendrite 42 made of sodium oxide $Na_2O$ grows from the cathode side K to the anode side (a high electric potential side) A.

When the growth of the dendrite 42 progresses while the cathode-ray tube is in operation, there occurs the above-mentioned electrical conductivity among the neighboring portions of the resistor pattern 37. For example, in the case of FIG. 2B, originally, the intermediate electrode portion 40 applies 14 kV, but because a substantial resistor becomes short due to the short-circuit of the resistor pattern 37 on the low voltage side, the electric potential at the intermediate electrode GM rises up to a voltage of 15 kV and the like, thereby giving rise to a defective focus.

Particularly in recent years, there is a growing demand that a resistor be used under electrically and mechanically severe conditions like the above-mentioned FEEAL-type electron gun 31 and the like, thereby making the conductivity problem among the resistor pattern 37 serious.

Also, when miniaturization of the electron gun 31 is implemented, because the space among the resistor pattern 37 becomes narrow and the short-circuit tends to occur easily, it has been difficult to miniaturize the electron gun 31.

SUMMARY OF THE INVENTION

In order to solve the above-mentioned problem, it is an object of the present invention to provide a resistor which has a long life span and is capable of being miniaturized by restraining a short circuit among a resistor pattern, and an electron gun equipped with this resistor for a cathode-ray tube as well as a manufacturing method of the resistor.

According to an aspect of the present invention there is provided a resistor which makes the natrium concentration of overcoat glass covering the resistor pattern and being coated on a surface thereof less than 500 ppm.

According to another aspect of the present invention, there is provided an electron gun for a cathode-ray tube which is provided with the resistor in which the natrium concentration of the overcoat glass coated on the surface thereof covering the resistor pattern is set to less than 500 ppm.

According to a further aspect of the present invention, there is proposed a method of manufacturing the resistor which has processes, at a time of manufacturing an overcoat glass coated on the surface thereof for covering the resistor pattern, after a process of crushing glass cullet which is a raw material of the overcoat glass, the powder of crushed glass is rinsed with pure water, and its natrium concentration is made less than 500 ppm.

According to the above-mentioned resistor of the present invention, by making the natrium concentration of the overcoat glass less than 500 ppm, the growth of dendrite due to migration of natrium ion among the overcoat glass, the resistor pattern and the like can be reduced.

According to the above-mentioned electron gun for a cathode-ray tube of the present invention, in the resistor for applying a required voltage to a required electrode, by making the natrium concentration of the overcoat glass thereof less than 500 ppm, the growth of dendrite due to migration of natrium ions among the overcoat glass, the resistor pattern and the like can be reduced and changes in the predetermined voltage can be restrained.

Also, according to the method of manufacturing the resistor of the present invention mentioned above, by rinsing the crushed glass powder with the pure water to reduce its natrium concentration, it is possible to manufacture the overcoat glass with a low natrium concentration.

BRIEF DESCRIPTION OF THE DRAWINGS

FIG. 2 is a schematic structural diagram of a resistor used in the electron gun of FIG. 1, in which

FIG. 4 is a schematic structural diagram of a resistor according to an embodiment of the present invention, in which

FIG. 6 is a schematic structural diagram (plan view) showing an electron gun for a cathode-ray tube according to the present invention.

DESCRIPTION OF THE PREFERRED EMBODIMENTS

According to the present invention, there are provided a resistor in which the natrium concentration of a overcoat glass converting its resistor pattern and coated on a surface is less than 500 ppm, an electron gun for a cathode-ray tube equipped with the resistor in which the natrium concentration of the overcoat glass, covering the resistor pattern and coated on the surface of the resistor, is made less than 500 ppm, and a method of manufacturing the resistor which has processes, at a time of making the overcoat glass for covering the resistor pattern and coating the surface thereof, after a process of crushing glass cullet which is raw material of the overcoat glass, the powder of the crushed glass is rinsed with pure water and to make its natrium concentration less than 500 ppm.

Now, embodiments of the present invention will be described with reference to the attached drawings.

Figure 4A:
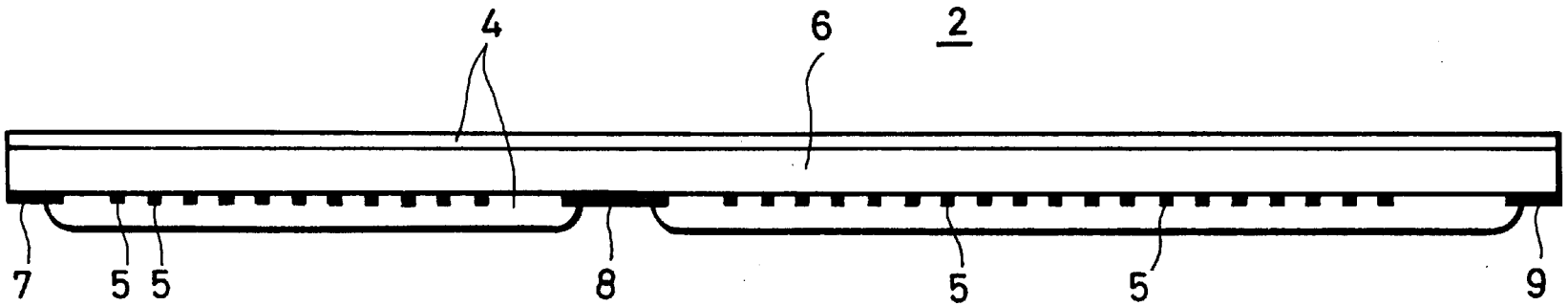
FIG. 4A is a cross-sectional view thereof and FIG. 4B is a plan view thereof.
Figure 4B:
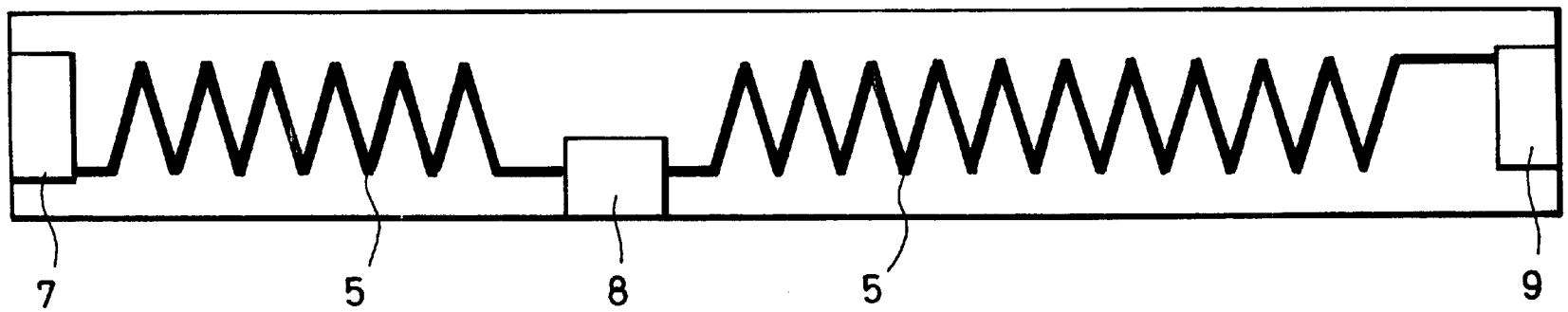

FIG. 4 shows a schematic structure of a resistor 2 according to an embodiment of the present invention. FIG. 4A is a cross-sectional view thereof and FIG. 4B is a plan view thereof. This resistor 2 has a resistor pattern 5 which is formed in such a manner that a conductive film mainly consisting of, for example, $Pb_2Ru_2O_7$ is painted on one surface of an insulating substrate 6, for example, a ceramic substrate made of an alumina substrate and the like with a predetermined pattern and is printed, fired and the like. At one end of the resistor pattern 5 is formed a low voltage electrode portion 9 which becomes a terminal for applying a low voltage. At the other end of the resistor pattern 5 is formed a high voltage electrode portion 7 which becomes a terminal for applying a high voltage and in the middle of the resistor pattern 5 is formed an intermediate electrode portion 8 which becomes a terminal capable of obtaining a voltage-divided intermediate voltage.

Then, on the resistor pattern 5 (both surfaces of the insulating substrate 6 in FIG. 4A) is formed an overcoat glass 4, for example, by firing to protect the resistor pattern 5 with a predetermined thickness, for as thick as several 10~several 100 $\mu$m, thereby constituting the resistor 2. According to the present invention, particularly the natrium concentration contained in the overcoat glass 4 is set to less than 500 ppm.

In the resistor 2, by applying a low voltage, for example, an earth voltage to the low voltage electrode portion 9 and a high voltage to the high voltage electrode portion 7, an intermediate voltage between the earth voltage and the high voltage is derived from the intermediate electrode portion 8.

Here, further a detailed description will be made about a growth of a dendrite in the resistor.

Figure 2A:
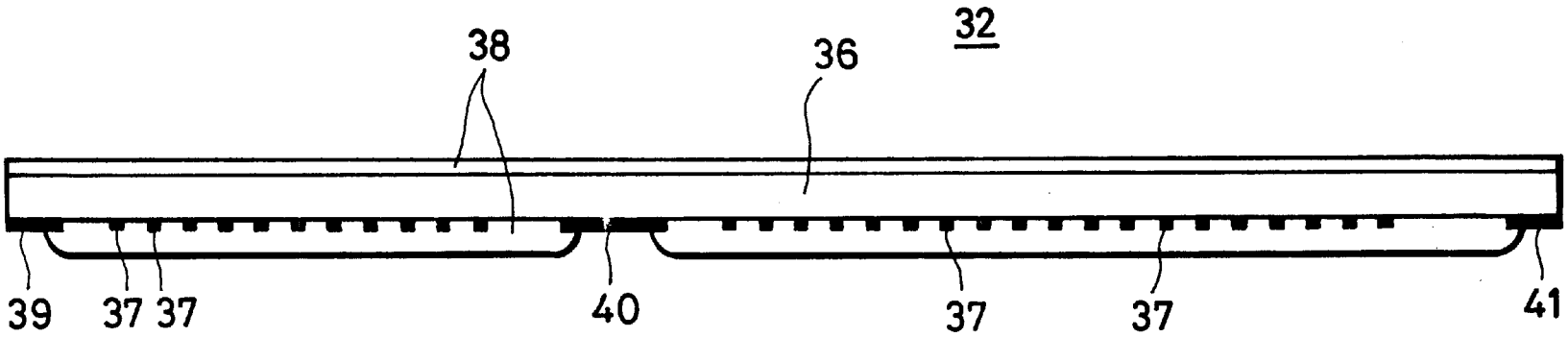
FIG. 2A is a cross-sectional view thereof and FIG. 2B is a plan view thereof.
Figure 2B:
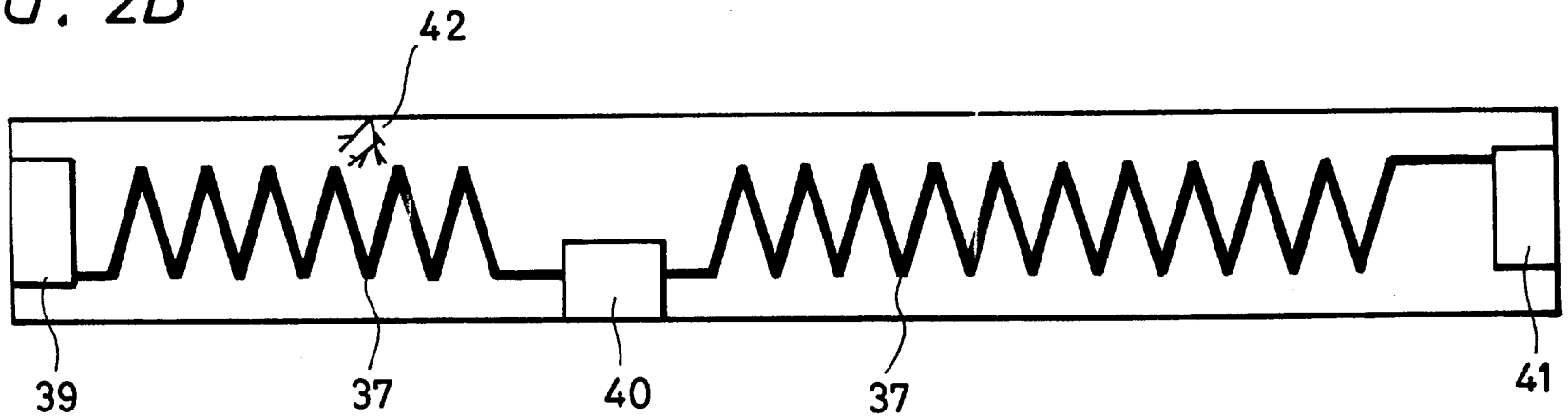

In addition to the case of the growth of dendrite from the edge portion of the above-mentioned overcoat glass 4 to the resistor pattern, the phenomena of the growth of the dendrite 42 shown in FIG. 2B would occur depending on conditions directly among the resistor pattern themselves, between the intermediate electrode portion and the resistor pattern as well as between the low voltage portion and the resistor pattern.

This growth of the dendrite can be explained according to an expression of ion migration which is shown in the following equation (1).

$$J_{Na} = A_o \cdot N_{Na} \cdot \exp(-Q/kT) \cdot dE/dx \cdot f(dT/dx) \quad (1)$$

$J_{Na}$: Na+ ion migration $A_o$: constant $N_{Na}$: number of Na atoms per a unit volume (atoms/cm$^3$)

$Q$: activated energy (eV)

$k$: Boltzmann constant $T$: operation temperature (K.)

$dE/dx$: potential gradient $f(dT/dx)$: function of temperature gradient $dT/dx$ Therefore, the following measures can be considered in order to stem the growth of the dendrite by suppressing the natrium ion migration from the equation (1).

(1) to reduce the number of natrium atoms (natrium concentration) $N_{Na}$ per the unit volume.

(2) to make the potential gradient dE/dx gentle.

(3) to restrain the operation temperature T and the temperature gradient dT/dx.

(4) to widen the distance among the resistor pattern 5 to make it difficult for the short circuit by the dendrite to occur.

However, in the cases of the above-mentioned items (2) and (3), because x is made larger and also in item (4), because the distance among the resistor pattern 5 is made wider, it becomes necessary to form the resistor 2 large in both cases. As a result, there are caused shortcomings such as an occurrence of restraint and the like as to the overall size of the resistor 2.

In contrast, item (1) does not need to make the overall size of the resistor 2 larger and is a technique suited for a smallsize resistor 2 which is built in, for example, a cathode-ray tube to be explained later.

According to the above-mentioned equation (1), it is understood that when conditions such as the operation temperature T, the potential gradient de/dx and the like are constant or the same the natrium ion migration $J_{Na}$ is in proportion to the natrium concentration $N_{Na}$.

Therefore, in the resistor 2 of FIG. 4, by reducing the natrium concentration $N_{Na}$ of the overcoat glass 4, the natrium ion migration $J_{Na}$ can be reduced according to equation (1).

When the natrium ion migration $J_{Na}$ is reduced, because the growth of the dendrite is restrained, the conduction among the resistor pattern 5 is restrained, thereby making it possible to extend a life span of the resistor 2.

The above-mentioned reduction of the natrium concentration can be attained by reducing the natrium concentration in each of materials for the overcoat glass 4, the insulating substrate 6 and the resistance pattern 5.

Particularly among them, the natrium concentration of the overcoat glass 4 is usually as high as 1000 ppm, so by reducing it to less than 500 ppm, the natrium ion migration $J_{Na}$ can be reduced, the growth of the dendrite is restrained and a period of time leading to the conduction among the resistor pattern 5 can be extended remarkably.

In this manner, according to the resistor 2 of the present embodiment, because the growth of the dendrite is restrained and the conduction among the resistor pattern 5 is restrained by setting the natrium concentration of the overcoat glass 4 to less than 500 ppm, the life span of the resistor 2 can be extended.

Also, because the conduction among the resistor pattern 5 can be restrained without making the size of the resistor 2 large, it is possible to implement miniaturization of the resistor 2 as compared with the prior art.

Figure 5:
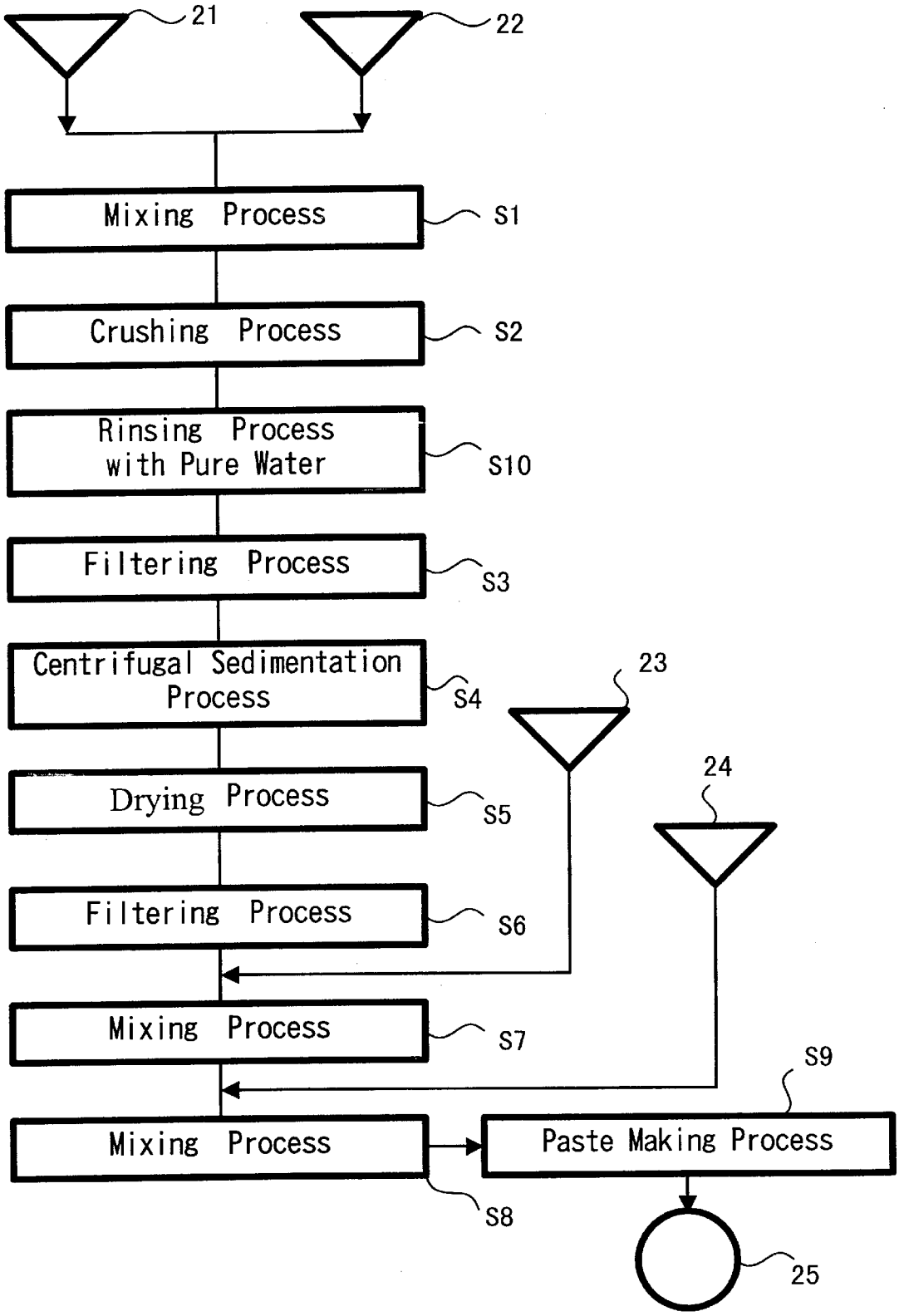
FIG. 5 is a manufacturing process chart of paste of overcoat glass according to a method of manufacturing a resistor of the present invention.
Figure 5:
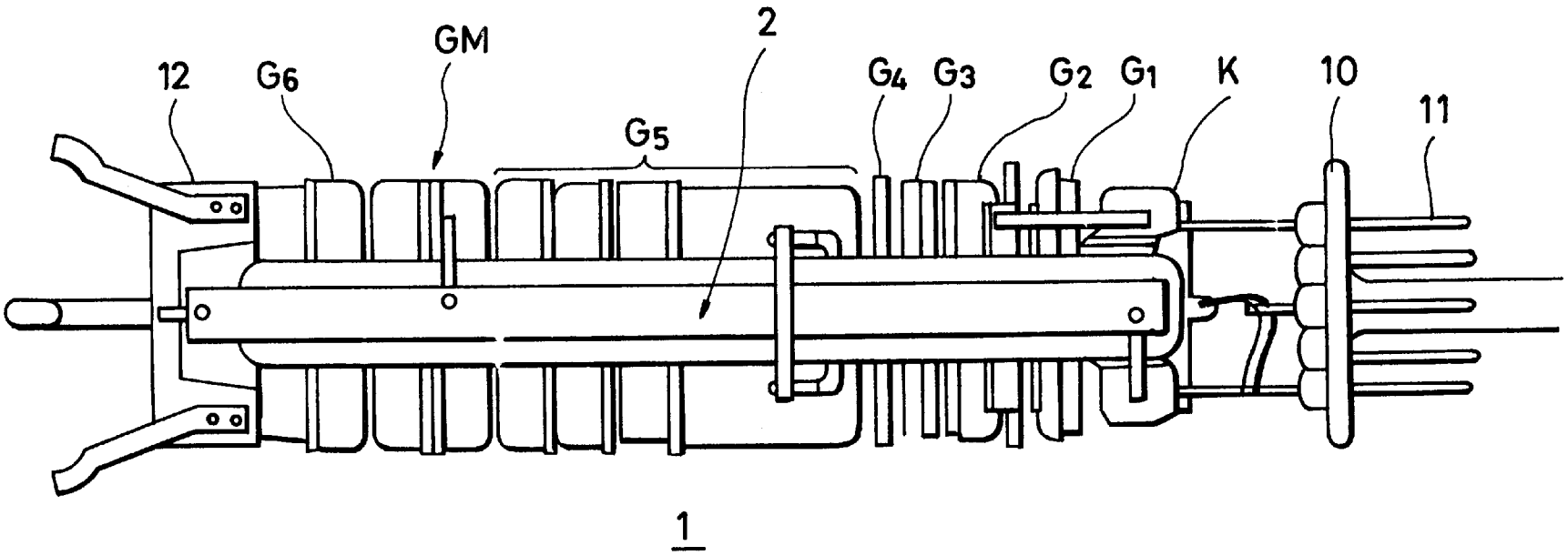

Next, in order to realize the overcoat glass 4 having the natrium concentration of less than 500 ppm to be used in the resistor of the present invention, there are following manufacturing methods. Manufacturing processes are shown in FIG.5.

First of all, a raw material of glass cullet 21 having as low natrium concentration as possible is used.

This raw material glass cullet 21 is mixed with water 22 (mixing process S1) and crushed (crushing process S2).

Next, after the crushing process S2, particularly the glass cullet 21, which was mixed with water 22 and crushed, is rinsed with pure water (pure water rinsing process S10). By providing this pure water rinsing process S10, a large amount of natrium ions are washed away, thereby making it possible to reduce the natrium concentration of the glass cullet.

Then, by using this raw material, filtration after the crushing (filtration process S3) is carried out. Further, separation is carried out by a centrifugal sedimentation settler (centrifugal sedimentation process S4).

Next, the product is dried (drying process S5) and filtration (filtration process S6) thereof is carried out again.

Further, the product is mixed with alumina 23 (mixing process S7).

Meanwhile, vehicle 24 is adjusted for making paste.

Lastly, the vehicle 24 is mixed with the glass (mixing process S8) to be made into paste (paste making process S9), thereby forming paste 25 for coating the overcoat glass 4.

By using the paste 25 for the overcoat glass 4, it is possible to manufacture the above-mentioned overcoat glass 4 having the natrium concentration of less than 500 ppm.

The resistor 2 can be manufactured, for example, in the following manner by using the paste 25 for the above-mentioned overcoat glass 4.

First of all, an electrode material such as a conductive paste, for example, a gold paste and the like is baked on the insulating substrate 6, for example, a ceramic substrate made of alumina and the like, to thereby form the high voltage electrode portion 7, the intermediate electrode portion 8 and the earth electrode portion 9 thereon.

Thereafter, a paste for the conductive film such as, for example, $Pb_2Ru_2O_7$ and the like is printed and coated on the insulating substrate 6 in a predetermined pattern. After its solvent is evaporated, it is fired to form the resistor pattern 5.

Further, the paste 25 for the above-mentioned overcoat glass 4 is printed and coated on the resistor pattern 5. Meanwhile, in the case of FIG. 4, the rear surface of the ceramic substrate 6 is also coated with the overcoat glass 4.

Then, by firing the paste 25 after being dried, the overcoat glass 4 can be formed covering the resistor pattern 5.

In this manner, the resistor 2 can be constituted.

The above-mentioned resistor 2 can be applied as a resistor for applying an intermediate voltage to, for example, the intermediate electrode of the electron gun for a cathode-ray tube, applying a focus voltage to a focus electrode of the electron gun, applying a convergence voltage in order to obtain a convergence characteristic of the electron gun and the like and further, can be applied as a resistor for a focus controller of a television receiver.

FIG. 6 shows a schematic structure of an electron gun 1 for a cathode-ray tube equipped with the above-mentioned resistor according to the present invention. FIG. 6 shows a case where the resistor is applied to the above-mentioned EFEAL-type electron gun.

The electron gun 1 comprises three cathodes K, though not shown, which generate electron beams corresponding to red R, green G and blue B, respective electrodes for accelerating and controlling the electron beams, that is, a first electrode G1, a second electrode $G_2$, a third electrode $G_3$, a forth electrode $G_4$, a fifth electrode G5, an intermediate electrode GM, a sixth electrode $G_6$ and a convergence cup 12. In FIG. 6, reference numeral 10 designates a stem and reference numeral 11 denotes a stem pin. A focus voltage is applied to the fifth electrode $G_5$, an anode voltage is applied to the sixth electrode $G_6$, and also, an intermediate voltage between the focus voltage and the anode voltage is applied to the intermediate voltage GM, respectively, thereby constituting a common electric field extended lens thereat.

Figure 1:
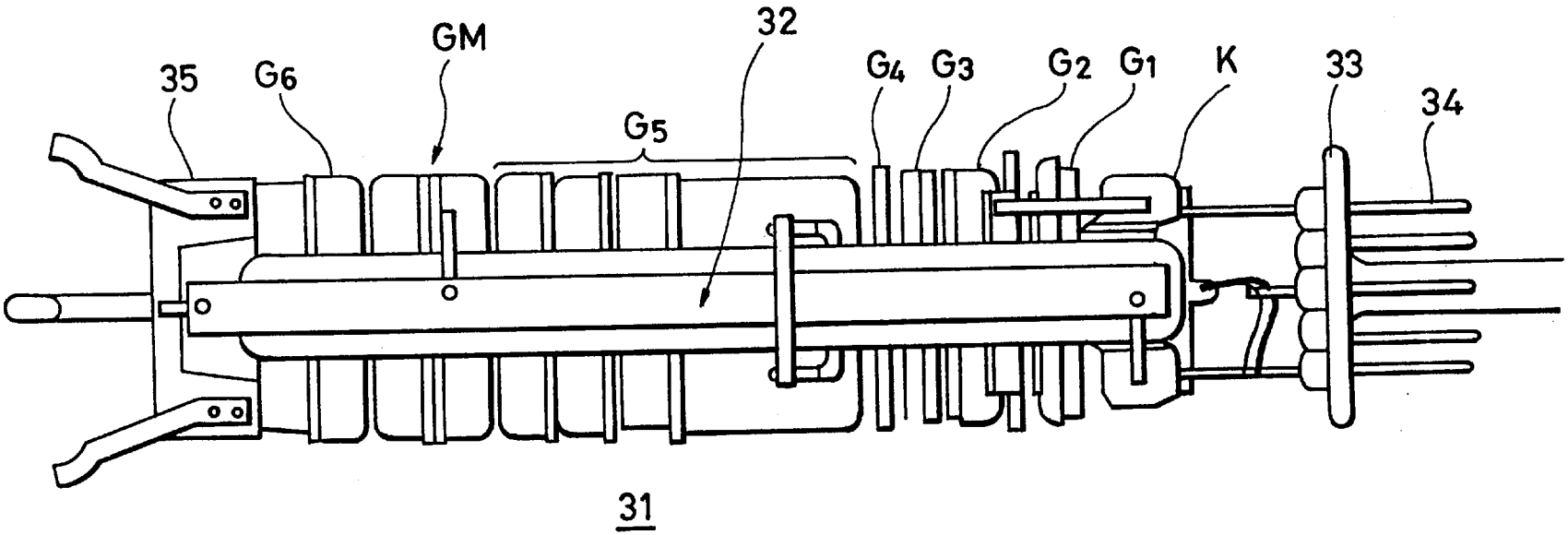
FIG. 1 is a schematic structural diagram (plan view) of an electron gun for an EFEAL-type cathode-ray tube.
Figure 3:
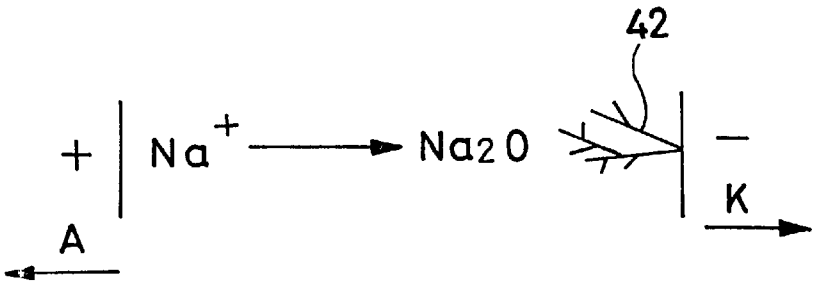
FIG. 3 is a diagram for explaining a growth of dendrite.

In the electron gun 1 having the EFEAL-type structure, like the above-mentioned electron gun 31 in FIG. 1, each of the fifth electrode $G_5$ the intermediate electrode GM and the sixth electrode $G_6$ has therein an electric field correcting electrode plate having beam penetrating apertures corresponding to the three electron beams which is not shown and each of electrodes $G_5$, GM and $G_6$ is shaped like a cylinder which is cross-sectionally elliptical.

Then, according to the present invention, particularly in order to apply the intermediate voltage from the resistor 2 shown in FIG. 4 to the intermediate electrode GM, the resistor 2 is disposed on one side of the electron gun 1.

The resistor 2 is attached to the electron gun 1 with its surface on which the resistor pattern 5 on the insulating substrate 6 is formed being on the outside, that is,on a neck glass side of the cathode-ray tube and the surface on the opposite side being on the electron gun 1 side.

The anode voltage, for example, a high voltage of 25~32 kV or so is applied to the high voltage electrode portion 7 at the left end of the resistor 2 and the low voltage electrode portion 9 at the right and becomes an earth electrode portion which is grounded or is connected to an externally attached resistor outside the cathode-ray tube.

In the electron gun 1 of FIG. 6, the high voltage electrode portion 7 of the resistor 2 is connected to the convergence cup 12, the earth electrode portion 9 is grounded through the stem pin 11 and the intermediate electrode portion 8 is connected to the intermediate electrode GM, respectively.

Then, an intermediate voltage between the focus voltage and the anode voltage, for example, an intermediate voltage of 14 kV, or as about half of the high voltage is derived from the intermediate electrode portion 8 of the resistor 2 and applied to the intermediate electrode GM of the electron gun 1.

According to the above-mentioned electron gun 1 for a cathode-ray tube , since it is provided with the resistor 2 whose life span is long and whose miniaturization can be implemented, fluctuations in the intermediate voltage applied to the intermediate electrode GM can be suppressed, faults of the cathode-ray tube can be reduced and also, miniaturization, extension of a life span and high reliability of the cathode-ray tube can be implemented. Therefore, any limitation on the design of the electron gun is hardly caused since the resistor 2 is miniaturized.

Meanwhile, the present invention may be applied to an electron gun in which the focus voltage is made to be applied from the intermediate electrode portion 8 of the above-mentioned resistor 2 as well as an electron gun in which the convergence voltage is made to be applied from the intermediate electrode portion 8 of the above-mentioned resistor 2. In a case where the resistor 2 in FIG. 4 is supposed to be a resistor for the focus voltage of an electron gun, for example, more or less than 25 percent of the high voltage and in a case where the resistor 2 is made to be a convergence voltage resistor for the electron gun, more or less than 95 percent of the high voltage, are derived from the intermediate electrode portion 8, respectively.

According to the resistor of the present invention, by setting the natrium concentration of the overcoat glass to be formed on the resistor film of the resistor to less than 500 ppm, the growth of the dendrite is restrained and the time period leading to the occurrence of conduction among the resistor pattern can be extended.

Therefore, a life span of the resistor can be extended.

According to the resistor of the present invention, because the conduction among the resistor pattern can be restrained without making the resistor large, implementation of miniaturization of the resistor becomes possible as compared with the prior art.

Also, according to the electron gun for a cathode-ray tube of the present invention, by providing with the resistor whose life span is long and whose miniaturization is implemented, faults of the cathode-ray tube can be reduced and further, miniaturization of the cathode-ray tube can be implemented.

Also, according to the method of manufacturing the resistor of the present invention, after crushing the glass cullet, by carrying out the rinsing process thereof with pure water, it is possible to manufacture the overcoat glass with a low natrium concentration.

As a result, the extension of the life span and the miniaturization of the resistor can be implemented.

Having described preferred embodiments of the present invention with reference to the accompanying drawings, it is to be understood that the present invention is not limited to the above-mentioned embodiments and the various changes and modifications can be effected therein by one skilled in the art without departing from the spirit or scope of the present invention as defined in the appended claims.

What is claimed is:

1. A method of manufacturing a resistor comprising the steps of:

when an overcoat glass coating a resistor pattern is manufactured, crushing a glass cullet which is a raw material of said overcoat glass, and then rinsing said crushed glass powder with pure water thereby setting its natrium concentration to be less than 500 ppm.

2. A method of manufacturing a resistor as described in claim 1, further comprising:

between said rinsing and setting steps, the additional steps of filtering the mixture of said crushed glass powder and said pure water, and separating said mixture by a centrifugal sedimentation settler.

3. A method of manufacturing a resistor as described in claim 2, further comprising:

between said separating and setting steps, the additional steps of drying said mixture, and re-filtering the mixture of said crushed glass powder and said pure water.

4. A method of manufacturing a resistor as described in claim 3, further comprising:

between said re-filtering and setting steps, the additional step of mixing said mixture with alumina.

5. A method of manufacturing a cathode ray tube comprising: making a resistor by the process as described in claim 1, and utilizing said resistor to provide an intermediate voltage to an intermediate electrode to an electron gun for a cathode ray tube.

* * * * *